US010920497B2

(12) United States Patent
Rothe et al.

(10) Patent No.: US 10,920,497 B2
(45) Date of Patent: Feb. 16, 2021

(54) NO BLADE BIT

(71) Applicant: Ulterra Drilling Technologies, L.P., Fort Worth, TX (US)

(72) Inventors: Mitchell Rothe, Montgomery, TX (US); Ben Chrest, Holmen, WI (US)

(73) Assignee: ULTERRA DRILLING TECHNOLOGIES, L.P., Fort Worth, TX (US)

( * ) Notice: Subject to any disclaimer, the term of this patent is extended or adjusted under 35 U.S.C. 154(b) by 40 days.

(21) Appl. No.: 16/243,697

(22) Filed: Jan. 9, 2019

(65) Prior Publication Data

US 2020/0217142 A1 Jul. 9, 2020

(51) Int. Cl.
*E21B 10/43* (2006.01)
*E21B 10/567* (2006.01)
*E21B 10/60* (2006.01)

(52) U.S. Cl.
CPC ..... *E21B 10/43* (2013.01); *E21B 10/602* (2013.01); *E21B 10/567* (2013.01)

(58) Field of Classification Search
CPC ..... E21B 10/43; E21B 10/55; E21B 10/567; E21B 7/26; E21B 7/265
USPC ..... 175/431, 327
See application file for complete search history.

(56) References Cited

U.S. PATENT DOCUMENTS

| | | | | |
|---|---|---|---|---|
| 3,269,470 | A | 8/1966 | Kelly, Jr. | |
| 4,246,977 | A | 1/1981 | Allen | |
| 4,907,662 | A * | 3/1990 | Deane | E21B 10/43 175/431 |
| 5,099,929 | A | 3/1992 | Keith et al. | |
| 5,131,478 | A * | 7/1992 | Brett | E21B 10/43 175/57 |
| 5,595,252 | A * | 1/1997 | O'Hanlon | E21B 10/43 175/393 |
| 6,170,576 | B1 * | 1/2001 | Brunnert | E21B 10/46 166/298 |
| 2002/0121393 | A1 * | 9/2002 | Thigpen | E21B 12/04 175/431 |
| 2012/0138365 | A1 | 6/2012 | Maurstad et al. | |

OTHER PUBLICATIONS

International Application No. PCT/US2020/012674, International Search Report and Written Opinion, dated Jun. 24, 2020, 15 pages.
International Application No. PCT/US2020/012674, "Invitation to Pay Additional Fees and, Where Applicable, Protest Fee", dated Apr. 3, 2020, 10 pages.

* cited by examiner

*Primary Examiner* — Kenneth L Thompson
(74) *Attorney, Agent, or Firm* — Kilpatrick Townsend & Stockton LLP

(57) ABSTRACT

A bladeless polycrystalline diamond compact (PDC) drill bit includes a head having a plurality of knots protruding from a drilling face of the head. Each of the plurality of knots includes a single cutter. Each of the cutters is arranged about a central axis of the head such that each cutter has a unique radial position and angular position relative to the central axis. The head defines at least one fluid port extending through the drilling surface.

22 Claims, 8 Drawing Sheets

NO BLADE BIT

BACKGROUND OF THE INVENTION

Conventional PDC drill bits include a number of blades arranged about a drilling face of the bit, with each blade supporting a number of cutting elements. Due to the arrangement of the blades and cutting elements, these bits suffer from several problems. Notably, the concentrations of cutters on each blade (at a same or similar angular position) cause high and irregular torque responses. This is especially true for cutters positioned near an outer periphery of the bit, since the torque generated on any cutter and/or blade is a function of the radial distance of the cutter from the center of the bit, with most outward cutters generating greater torque values. The high and irregular torque responses may lead to bit whirling, as well as result in especially high forces being applied to a small subset of the cutting elements on a particular blade that may cause excessive wear or other damage to one or more of the cutting elements and/or blades. Additionally, conventional PDC drill bits position fluid ports between individual blades of the bit. However, such positioning only allows these ports to supply cooling fluid to the cutting edge of the cutting element, which provides sub-optimum cooling ability. Embodiments of the present invention provide solutions to these and other issues associated with conventional PDC drill bits.

BRIEF SUMMARY OF THE INVENTION

Embodiments of the present invention are directed to PDC drill bits that have an asymmetrical arrangement of cutters on a drilling face of the bit. Each of the cutters has a unique angular position relative to a central axis of the bit. In some embodiments, each cutter (or a substantial number of the cutters) may have a unique radial position as well. The asymmetrical arrangement of cutters at unique angular and/or radial positions in a bladeless design reduces the concentration of cutters at similar angles and thus helps reduce the amount of torque experienced at any individual cutter or subset of cutters. This results in a PDC drill bit that exhibits a more consistent torque profile and reduces the occurrence of bit whirl and excessive damage to the cutters themselves. PDC drill bits according to the present invention also include number of knots that project outward from the drilling face and that serve as mounting sites for the various cutters. These knots provide mounting sites for the cutters that may project outward from the head of the PDC drill bit at different distances and/or angles such that the cutters define a desired cutting profile of the PDC drill bit. The drill bits described herein also provide fluid ports that are arranged to sit between multiple ones of the knots and deliver cooling fluid to all or a substantial portion of a surface of each cutter. As a substantial surface area of each cutter is in contact with the cooling fluid, the cutters are cooled much more effectively than in conventional PDC bits that only supply cooling fluid to the cutting edge of each cutting element.

In one embodiment, a bladeless polycrystalline diamond compact (PDC) drill bit is provided. The PDC drill bit may include a head having a plurality of knots protruding from a drilling face of the head. Each of the plurality of knots may include a single cutter. Each of the cutters may be arranged about a central axis of the head such that each cutter has a unique radial position and angular position relative to the central axis. The head may define at least one fluid port extending through the drilling surface.

In some embodiments, the angular position of each successive one of the cutters is incremented by between about 131 and 143 degrees starting from an innermost cutter relative to the central axis. The at least one fluid port may extend through the drilling surface between bases of respective ones of the plurality of knots. In some embodiments, each of the at least one fluid port may provide a fluid path through the head such that fluid supplied through each of the at least one fluid port engages multiple of the cutters wholly laterally. For example, each cutter may be exposed to transversely flowing drilling fluid on both the fronts and the side, as well as the face to maximize the contact area of the cooling fluid. In some embodiments, a difference in the radial position of successive cutters near the central axis may be greater than the difference in the radial position of successive cutters further from the central axis. In some embodiments, spacing between adjacent cutters is equal in all angular directions. In some embodiments, the plurality of knots may cover substantially an entirety of the drilling surface of the head.

In another embodiment, a bladeless PDC drill bit may include a head having a plurality of cutters. Each of the plurality of cutters may be positioned on a knot that protrudes outward from a drilling face of the head. Each of the cutters may be arranged about a central axis of the head such that each cutter has a unique radial position and a unique angular position relative to the central axis. The angular position of each successive one of the plurality of cutters following a most inward one of the plurality of cutters may be incremented approximately by the golden angle. The head may define at least one fluid port extending through the drilling surface.

In some embodiments, a leading edge of each of the plurality of cutters may be oriented such that the leading edge is normal to the central axis of the head. Each of the plurality of cutters may be brazed to a respective knot. At least some of the knots may include multiple ones of the plurality of cutters. Each knot may be integrally formed with the head of the PDC drill bit. In some embodiments, each of the plurality of cutters may include a generally flat leading edge. Each of the generally flat leading edges may be oriented in a different angular direction.

In another embodiment, a bladeless PDC drill bit may include a head having a plurality of cutters. Each of the plurality of cutters may be positioned on a knot that protrudes outward from a drilling face of the head. An angular position of each successive one of the plurality of cutters following a most inward one of the plurality of cutters may be incremented by between about 131 and 143 degrees about a central axis of the head such that the angular position of each of the cutters is unique. The head may define a plurality of fluid ports extending through the drilling surface at positions between the plurality of cutters.

In some embodiments, at least some of the knots may include both a primary cutter and a backup cutter that is positioned generally behind the primary cutter. Each of the plurality of cutters may include a unique radial position and the radial position of each of the plurality of cutters may be determined based on a particular one of a plurality of cutter zones within which a particular one of the plurality of cutters is placed. Each of the plurality of cutting zones may have a same 2-dimensional area relative to the drilling face of the head with an outer boundary of each of the plurality of cutting zones being determined based on a relationship of $$R_Z = \sqrt{\frac{Z * D_H^2}{N}},$$

where Z is a zone number representing a particular cutting zone on the head, $D_H$ is a diameter of the drilling face of the head; N is a number of cutting zones on the head, and $R_Z$ is a radial position of the outer boundary of the particular cutting zone. In some embodiments, the plurality of cutters may be arranged as opposing pairs that are spaced 180 degrees apart relative to the central axis of the head. Each cutter within a set of opposing pairs may be spaced at a same radial position. In some embodiments, at least some of the plurality of cutters are of different sizes.

In another embodiment, a method of using a bladeless PDC drill bit is provided. The method may include coupling a bladeless PDC drill bit to a drill string. The bladeless PDC drill bit may be like any of the bits disclosed here, and as one example may include a head having a plurality of knots protruding from a drilling face of the head. Each of the plurality of knots may include a single cutter. Each of the cutters may be arranged about a central axis of the head such that each cutter has a unique radial position and angular position relative to the central axis. The head may define at least one fluid port extending through the drilling surface. The method may also include rotating the drill string and the bladeless PDC drill bit and engaging the bladeless PDC drill bit with a material that is to be excavated.

In some embodiments, the method may include supplying a cooling fluid to the drilling face of the bladeless PDC drill bit via the at least one fluid port such that the cooling fluid engages multiple of the cutters wholly laterally. In some embodiments, the angular position of each successive one of the cutters may be incremented by between about 131 and 143 degrees starting from a most-inward cutter relative to the central axis. In some embodiments, the angular position of each successive one of the cutters may be incremented in a clockwise direction.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a set of parentheses containing a second label that distinguishes among the similar components. If only the first reference label is used in the specification, the description is applicable to any one of the similar components having the same first reference label irrespective of the second reference label.

DETAILED DESCRIPTION OF THE INVENTION

Figure 1A:
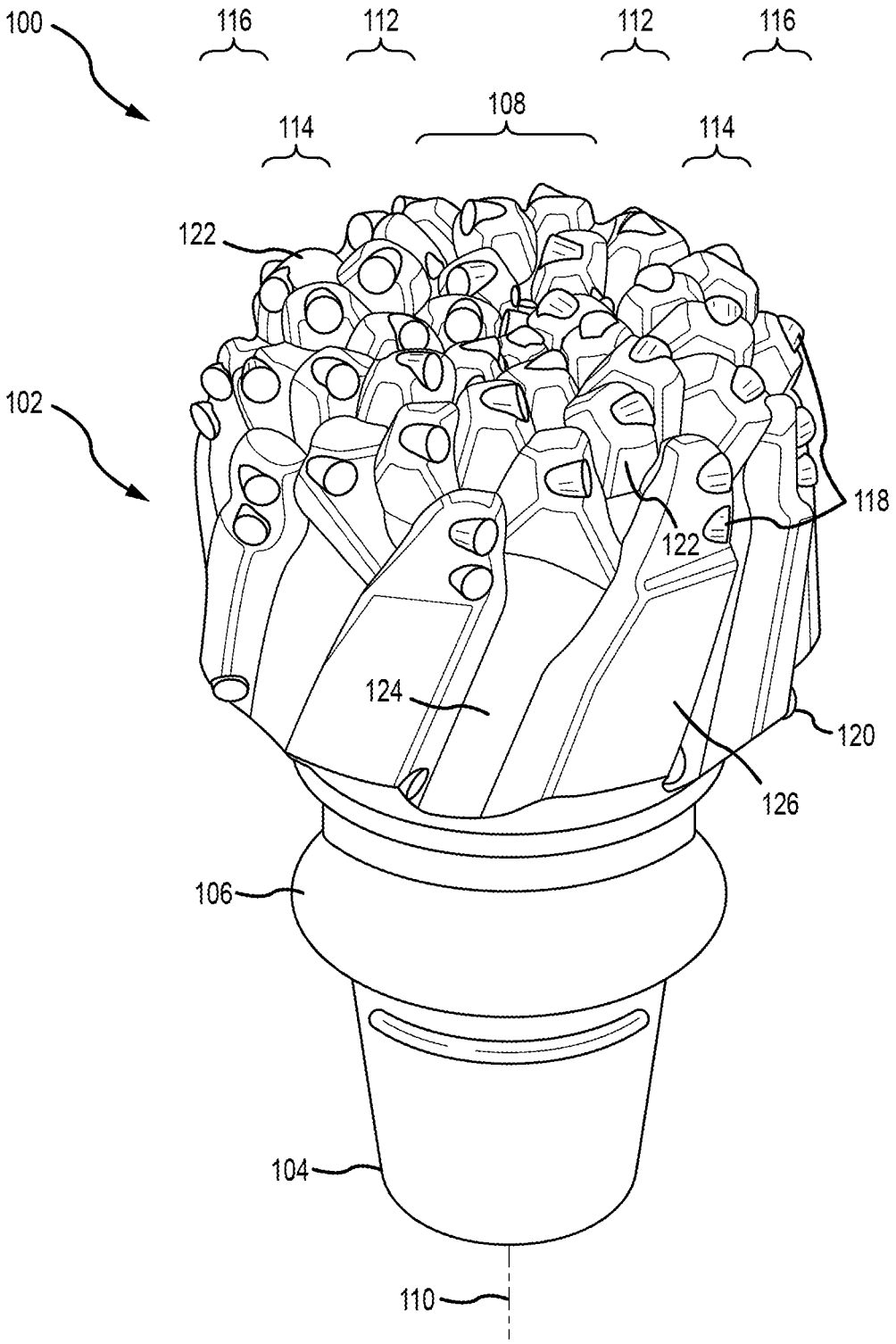
FIG. 1A depicts an isometric side view of a bladeless PDC drill bit according to embodiments of the invention.

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention are directed to improved polycrystalline diamond compact (PDC) drill bits that generate reduced and more consistent torque profiles, as well as that reduce the amount of bit whirl experienced as compared to conventional PDC drill bits. During bit whirl, the instantaneous center of rotation moves around the face of the bit, and the bit whirls backward or forward around the borehole. Cutters on a whirling bit can move sideways, backward, and at much faster rates than those on a true rotating bit. The impact loads associated with this motion cause PDC cutters to chip and/or break, which, in turn, accelerates wear. The drill bits of the present invention provide reduced torque profiles and the occurrence of bit whirl by utilizing new techniques of arranging the cutters on a drilling face of the drill bit. In particular, drill bits of the present invention arrange a number of cutters on the drilling face of the bit with each cutter having its own unique angular position (and oftentimes unique radial position) relative to a central axis of the bit. For example, in some embodiments all cutters on a single blade have a similar differences in angle around. Additionally, the angle around difference from blade to blade in conventional bits is a pattern that can resonate and cause whirl. The present drill bit designs eliminate the use of blades to help eliminate or reduce the ability of the drill bit to resonate. Instead, embodiments of the present invention arrange cutters on a number of knots that protrude from a drilling surface of the bit, oftentimes with only a single cutter on each knot. Each knot is a nub that projects outward from the drilling surface, oftentimes with the respective cutter(s) being generally centered on the knot. Such arrangements help minimize the concentrations of cutters at similar radial and/or angular positions, such as seen on bladed bits, and helps reduce the amount of torque experienced by the drill bit, especially proximate the outer periphery of the PDC drill bit, to minimize the occurrence of bit whirl.

Embodiments of the present invention also provide cutter layouts that ensure that individual cutters rarely have clearance issues with adjacent cutters. In contrast, on standard bladed PDC drill bits, cutters must be spaced along a blade front such that enough clearance exists between them to provide enough structural integrity to the cutter pockets so that they stay intact during the drilling process. The present invention creates a distribution of cutters' angles around that prevents one cutter from obstructing the position of another, allowing for higher degrees of cutter density at critical areas of the bit.

Embodiments of the present invention also provide greater durability as compared to conventional PDC drill bits. When calculating and plotting the work (which may reflect the volume of rock a cutter will remove in one revolution) of each cutter, a single depth of cut must be considered as the optimal value to represent the majority of drilling time the bit should experience in the desired interval. This assumes that all cutters fall the same axial distance in a single rotation. The work calculation involves determining the area each cutters sees of the formation, considering the locations both radially and angularly of the adjacent cutters based on the optimal depth of cut. On conventional bladed PDC bits, the angular positions are fixed based on the blade designs, so only the radial location of the cutters may be varied to optimize a work curve. This requires that the cutters on a conventional bladed PDC bit be designed to provide a "smooth" work curve at this single selected depth of cut. This ensures that the distribution of loads in a given area are normalized, limiting the loads on a single cutter, thus increasing the durability of the drill bit. This is done by individually adjusting cutters' radially locations until the work plot appears smooth. At the common irregular angles around, this work per cutter becomes less smooth when analyzed at different depths of cut than the "optimized" depth. This causes some cutters to produce a "spike" in work or torque at depths of cut that deviate from the selected depth, which ultimately leads to overloading and premature failure. When cutters are spaced at regular angles around as done in embodiments of the present invention, the angular effects of the work calculation are nullified. This guarantees that all depths of cut are just as "smooth" as the selected depth of cut, thus preventing cutters from being overloaded during ideal conditions of drilling homogenous formations on center. In real world drilling, bits will drill through multiple formations, utilize many different drilling parameters and ultimately experience a vast range of depths of cut. If a bit can maintain a smooth work throughout the entire range of depths of cut, peak loads can be avoided and durability will be improved.

Embodiments of the present invention also provide improved thermodynamic properties so as to better cool the individual cutters in comparison to conventional PDC drill bits. Conventional bladed PDC drill bits provide fluid ports that are arranged on a face of the bit such that the ports supply cooling fluid primarily to the cutting edge of each cutter. In such drill bits, any cooling fluid that is supplied to a main body of the cutters is merely the result of incidental splashing of the fluid. The prevalence and location of such incidental splashing is unpredictable and cannot be relied upon to consistently contact and cool any part of the individual cutters aside from the cutting edge. Oftentimes, such cooling profiles are the result of fluid ports being positioned between the individual blades on which the cutting elements of conventional PDC drill bits are mounted. Channels formed between the individual blades provide junk slots that define fluid paths for the cooling fluid to pass by the cutting edges of the cutting elements arranged on each blade. In contrast, embodiments of the present invention place fluid ports in between bases of adjacent ones of the knots. The fluid ports are arranged in such a manner that as cooling fluid supplied by the ports reaches the drilling surface of the bit, a path of the cooling fluid toward an outer periphery of the bit is interrupted by several knots and cutters. Additionally, such designs typically do not include well-defined, elongate channels, as the arrangement of knots provides a zig-zagging gap/flow path that extends about the drilling face. Such an arrangement causes the cooling fluid to flow over the knots and cutters such that the cooling fluid contacts all or a substantial portion of the exposed surface of each cutter—not just the cutting edge. The greater area of surface contact between the cooling fluid and the cutters results in more effective and consistent cooling of the cutters.

Turning now to FIG. 1A, an isometric view of one embodiment of a polycrystalline diamond compact (PDC) drill bit 100 is illustrated. The PDC drill bit 100 includes a drill bit head 102, a threaded pin 104 is provided on an upper section or shank 106 of the PDC drill bit and may be used to secure the PDC drill bit 100 to a drill string. The shank 106 defines a breaker slot that is configured to be engaged by a bit breaker box to grasp the PDC drill bit 100 and prevent the PDC drill bit 100 from turning while the PDC drill bit 100 is tightened onto or loosened from the drill string. It will be appreciated that the shank 106 may be formed integral with the head 102 to form a single-piece PDC drill bit 100 or may be formed separately and later joined to the head 102. Shank 106 and/or head 102 may be formed using matrix and/or other casting techniques, by milling and/or otherwise machining the component(s) (although this may be expensive and time consuming due to the complexity of the components as described elsewhere herein), and/or through rapid prototyping techniques, such as 3D printing.

The head 102 includes a cone section 108, which encircles a central longitudinal axis 110 of the PDC drill bit 100 about which the PDC drill bit 100 is designed to rotate. A nose section 112 is disposed around the cone section 108 and extends toward a shoulder section 114 where the outer (drilling) surface of the PDC drill bit 100 tapers rearward toward a gauge section 116 that defines a largest diameter of the PDC drill bit 100. Each of the cone section 108, nose section 112, shoulder section 114, and gauge section may include a number of cutters 118 mounted on outer surfaces of each respective section of the head 102. In some embodiments, one or more back ream cutters 120 may be positioned near a base of the head 102. The head 102 may also include one or more gauge pads 126, which may be used to provide stability to the PDC drill bit 100, as well as provide relief from the sides of the borehole. These gauge pads 126 may be elongated and positioned along sides of the head 102 in the gauge section 116, with gaps between the gauge pads 126 forming junk slots 124 through which cutting material and fluids may pass.

Each cutter 118 may be positioned on a knot 122 and/or other support structure that projects outward from the drilling surface of the head 102. Unlike some conventional drill bits that have cutter mounting structures that are formed separately and mounted into the head (such as by utilizing rods that are inserted within recesses formed within the head), the knots 122 may be formed integrally with the rest of the head 102, which results in a stronger, more durable PDC drill bit 100. In some embodiments, each knot 122 may project outward at a different angle and/or distance than the other knots 122, with a tip of each knot 122 defining a mounting position for at least one cutter 118 such that the projection distance of each knot 122 sets a position of the cutter(s) 118 mounted thereon. The angular and radial position of each knot 122 may be determined based on a desired position of a particular cutter 118, oftentimes with the cutter 118 approximately centered on a respective knot 122. Oftentimes, each knot 122 will include only a single cutter 118, however, in some embodiments, some or all of the knots 122 may include multiple cutters 118. For example, in some embodiments, some or all of the knots 122 may include backup cutters that are positioned at least partially behind a respective primary cutter. As another example, individual knots 122 may extend between the shoulder section 114 and the gauge section 116, with a shoulder cutter 118 and a gauge cutter 118 being positioned on a single knot 122.

In some embodiments, the knots 122 may cover all or a substantial portion of the drilling surface of the head 102. For example, in some embodiments, such as the embodiment illustrated in FIG. 1A, the knots 122 may cover greater than 90%, 95%, 98% or more of the drilling surface of the head 102, with minimal gaps formed between the bases of adjacent ones of the knots 122. In other embodiments, the knots 122 may cover less of the drilling surface of the head 102. For example, the knots 122 may cover less than 90%, 75%, or 50% of the drilling surface of the head. It will be appreciated that any amount of the drilling surface of the head 102 may be covered by knots 122 based on the design requirements of a particular drilling application. The number, size, and/or placement of the knots 122 may be driven based on the number and layout of the cutters 118, with greater number of cutters 118 typically resulting in greater coverage of the drilling surface of the head 102 by knots 122.

Knots 122 may have various shapes and/or sizes, and in some embodiments, the shape and/or size of a particular knot 122 may be based on the positioning of the knot 122, as well as on how many cutters 118 the knot 122 is designed to support. As one example, a size of individual knots 122 may increase as the radial distance relative to the central axis 110 for each knot 122 is increased. As another example, in the illustrated embodiment, some or all of the knots 122 in the cone section 108, the nose section 112, and/or the shoulder section 114 may have five exposed sides, with four of them being sidewalls and a fifth being an outermost face that extends between the four sidewalls. On such knots 122, the outermost face serves as a mounting site for at least one cutter 118 such that the leading edge of the cutter 118 extends beyond a distal-most point of the knot 122 and helps drive a thickness of a particular knot 122. The dimensions of the sidewalls may help drive both a thickness of the knot 122 and an amount of outward projection of the knot 122. Oftentimes, the junctions between the adjacent ones of the sidewalls, as well as the junctions with the outermost face are rounded. In some embodiments, some or all of the sidewalls have a generally rectangular shape, while in other embodiments, some or all of the sidewalls have generally trapezoidal shapes. Similarly, the outermost face of the various knots may be generally rectangular and/or generally trapezoidal. While shown here with generally rectangular and/or trapezoidal faces and sidewalls, it will be appreciated that in some embodiments other shapes may be used, such as circles, pentagons, triangles, etc. In some embodiments, the sidewalls of a knot 122 may be tapered such that the knot 122 has a larger thickness at the base of the knot 122 than at the position of the cutter 118, which provides additional strength to each knot 122 to handle the high torques experienced during the drilling process while minimizing the amount of material needed to form each knot 122. Typically, such knots 122 are oriented such that the outermost faces are generally forward-facing (in a downhole direction), oftentimes with the cutters 118 being supported at profile angles within 60 degrees (and more often within 45 degrees) of the central axis 110 of the PDC drill bit 100.

In some embodiments, some or all of the knots 122 on the shoulder section 114 and/or gauge section 116 may be shaped very differently than the remaining knots 122. In some embodiments, some or all of the knots 122 on the gauge section 116 may be in the form of gauge pads 126. For example, as illustrated, some or all of the knots 122 on the gauge section 116 are gauge pads 126 having six exposed sides, with five sidewalls and a sixth outermost face. The sidewalls may join with one another to form a generally pentagonal shape that defines an outer periphery of the outermost face. In some embodiments, such as illustrated here, the outermost face of each of these gauge pads 126 may have two different surfaces, with one projecting further outward in a radial direction than the other. In some embodiments, the most radially outward surface may include only back ream cutters 120 at a lowest point of each gauge pads 126, while shoulder and/or gauge cutters 118 are positioned on a radially inward surface of the outermost face. In some embodiments, gaps are formed between adjacent ones of these gauge pads 126, with the gaps creating junk slots 124 through which drilling material and/or fluid may be evacuated during the drilling process. Oftentimes, the gaps/junk slots 124 are formed entirely or primarily in the gauge section 116 along lateral surfaces of the PDC drill bit 100. For example, in contrast to the five-sided knots 122 of the cone section 108, the nose section 112, and/or the shoulder section 114, rather than providing generally forward-facing outermost faces, the gauge pads 126 may be oriented in a generally radial direction and may be configured to support cutters 118, especially gauge cutters 118, that define a largest diameter of the head 102. For example, portions of the gauge pads 126 may project outward from the central axis 110 at angles of between about 85° and 95°. Oftentimes, the gauge pads 126 may support multiple cutters 118 at similar angular positions. For example, as shown, each gauge pad 126 includes both a shoulder cutter 118 and a gauge cutter 118 positioned at the same, or approximately the same, angular position. It will be appreciated that variations exist and that in some embodiments, the gauge pads 126 may support only a single cutter 118 at a particular angular position.

While described here with tapered shapes having rectangular and/or trapezoidal cross-sections, it will be appreciated that other shapes of knots 122 may be used to support the cutters 118. Additionally, it will be appreciated that the size of the knots 122 in a particular section of the head 102 or throughout the entirety of the head 102 may be consistent sizes and/or shapes, while in other embodiments, some of all of the knots 122 may be different sizes and/or shapes within one or more zones of the head 102. In some embodiments, each knot 122 has a unique size and/or shape, which may be based on the radial and/or angular position of the knot 122 and/or the cutter(s) 118 the particular knot 122 supports.

The number, size, and shape of knots 122 provide the cutters 118 relief from primary surface of the head 102, as well as drive a general shape of the head 102. For example, the height of each knot 122, as well as the angle at which the knot 122 projects outward from the head 102 relative to the central axis 110 determines whether the profile of the head 102 is a flat or shallow cone, a tapered, or a parabolic (short/medium/long) profile.

As illustrated here, the head 102 is formed with the knots 122 in the cone section 108 and inner portion of the nose section 112 being oriented substantially forward (in a generally axial direction of the PDC drill bit 100), with knots 122 on the outer portion of the nose section 112 starting to project outward from the central axis 110 at greater angles as the radial positions of the knots 122 increase. The knots 122 on the shoulder section 114 project outward at even greater angles (oftentimes between 30 and 70 degrees) relative to the central axis 110 to define the taper of the PDC drill bit 100 from a front face to the sides of the PDC drill bit 100. The knots 122 that extend in both the shoulder section 114 and the gauge section 116 may project outward from the head 102 in a substantially radial direction.

The profile of the head 102 of the PDC drill bit 100 matches the arrangement of the cutters 118, as each of the knots 122 includes one or more cutters 118. This allows the PDC drill bit 100 to bore a hole having a shape that generally corresponds to the profile of the head 102. Because of the different angles of projection of the various knots 122, the cutters 118 are also oriented at different angles relative to the central axis 110.

In some embodiments, each cutter 118 may be a sintered tungsten carbide cylinder with one flat surface that includes a synthetic diamond material. The cutters 118 are arranged on the knots 122 with the diamond coated cutter surface facing the direction of rotation of the PDC drill bit 100 to provide full coverage of a bottom of a borehole. Each cutter 118 may include a diamond table that is formed from diamond grit that is sintered with tungsten carbide and metallic binder to form a diamond-rich layer. The diamond table may be wafer-like in shape and may made as thick as structurally possible to increase wear life, with thickness commonly being between about 2 mm to 4 mm. Each cutter 118 may also include a tungsten carbide substrate, which is normally between about 0.3 in. and 0.7 in. high, with heights of about 0.5 in. most common. Oftentimes, the substrate has a same cross-sectional shape and same dimensions as the diamond table. Rather than having a pointed tip as shown in many conventional cutting elements, cutters 118 may include a sharp leading edge that is formed from a portion of a diamond-coated edge of the cylindrical body of the cutter 118. This leading edge is in the form of a generally flat cutting surface that curves slightly about a central longitudinal axis of the cutter 118.

The cutters 118 are typically attached to the knots 122 by brazing. For example, a pocket or cavity may be formed in an outer surface of a knot 122, with the pocket being sized and shaped to receive a portion of an individual cutter 118. A filler material having a lower melting temperature than the knot 122 and the cutter 118, such as flux, silver alloys, bronze alloys, copper, and/or other metallic material, is melted into the pocket and the cutter 118 is inserted into the pocket before the filler material is allowed to cool. Once cooled, the filler material secures the cutter 118 to the knot 122. While the cutters 118 illustrated in FIG. 1A are generally cylindrically-shaped as described above, it will be appreciated that in some embodiments different cutter designs may be utilized in accordance with the present invention.

The cutters 118 are arranged on the drilling surface of the head 102 such that a leading cutting edge of each cutter is substantially normal (such as within about 3°) to the central axis 110 of the PDC drill bit 100, which ensures that the cutting surface of each cutter 118 is properly aligned with the material that is being excavated when the PDC drill bit 100 is rotated. Additionally, the cutters 118 are arranged on the knots 122 and/or gauge pads 126 such that the cutting edge is substantially flush with at least one face (such as one of the sidewalls) of the knot 122 and/or gauge pad 126. This ensures that the cutting edge may be properly cooled and cleaned, while not being subjected to excessive wear. For example, if the cutting edge projects too far out from the face of the knot 122 and/or gauge pad 126, flowing cooling and/or other fluids may erode the cutting edge. If the cutting edge is recessed too far within the face of the knot 122 and/or gauge pad 126, the cutting edge will not be exposed to enough fluid to properly cool or clean the cutting edge, which can create jams of cut material around the PDC drill bit 100. Additionally, each cutter 118 may project slightly outward from at least one face (such as one of the outermost faces) of the knot 122 and/or gauge pad 126. Such projection provides the respective knot 122 and/or gauge pad 126 relief from the cutting formation so as to provide a space for fluid and/or junk to flow to the junk slots 124.

Figure 1B:
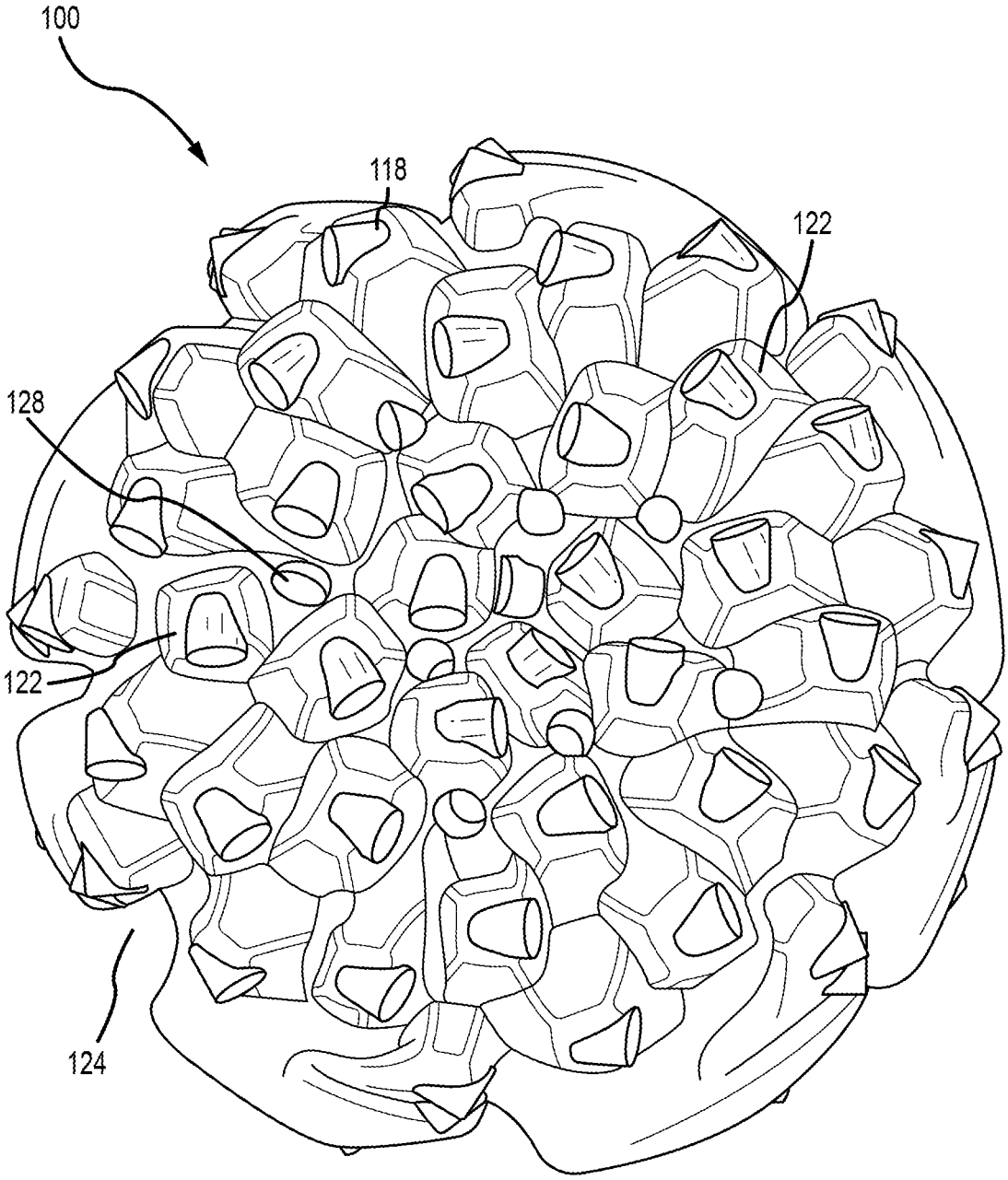
FIG. 1B depicts a top view of the bladeless PDC drill bit of FIG. 1A.

As best illustrated in FIG. 1B, the cutters 118 may be arranged about the drilling surface of the head 102 in a manner such that no two cutters 118 are at the same angular position relative to the central axis 110. In some embodiments, each cutter 118 may also have a unique radial position, which is based on a radial distance of the cutter 118 from the central axis 110. Due to each cutter 118 having a unique angular position and the cutters 118 each being normal to the central axis 110 of the PDC drill bit 100, the leading edges of each cutter 118 are each oriented at different angles such that each leading edge has a unique angular orientation.

In some embodiments the radial position and/or angular position of each cutter 118 is based on a central point (based on a longitudinal axis of the cutter 118) of the leading edge of the cutter 118, while in other embodiments, the position of each cutter 118 may be based on another common feature of each cutter, such as a center of mass, etc.

In some embodiments, the arrangement of the cutters 118 on the drilling face of the head 102 may be determined in a formulaic manner to achieve the desired asymmetrical layout with each of the cutters 118 having its own unique angular position relative to the central axis 110. For example, the cutters 118 may be laid out upon the drilling face in a manner such that when starting from a most inward cutter 118, the angular position of each subsequent is incremented by a fixed angle. For example, in some embodiments, the angular position of each subsequent cutter 118 may be incremented by approximately the golden angle (~137.5° or ~2.4 radians). Incrementing the angular position of each of the cutters 118 using the golden angle results in each cutter 118 having a unique angular position relative to the central axis 110. It will be appreciated that as referred to herein, the term "golden angle" may refer to a range of angles that are slightly different from the absolute golden angle but still may be utilized to achieve similar benefits. For example, numerous angles between about 131° and about 143° may be utilized to generate formulaic cutter layouts that ensure that each cutter 118 has a unique angular position and may be considered to approximate the golden angle in accordance with the present invention. It will be appreciated that the incrementing of the angular position of each cutter 118 may be done in a clockwise or counterclockwise direction in various embodiments. As just one example, the first (most inward) cutter 118 may be placed at a position that may be considered the zero degree position. The second most inward cutter 118 may then be placed at a position that is between 131° and 143° from the first cutter 118 relative to the central axis 110 (such as at the 137.5° or the 222.5° position, depending on the direction the angular position is incremented). A third cutter 118 may then be positioned between 131° and 143° from the second cutter 118 (such as at the 275° or the 85° position). Such a pattern may be continued until all the cutters 118 are arranged on the head 102.

Arrangements of the cutters 118 in accordance with the above techniques result in much more consistent and lower torque profiles than exhibited in conventional bladed PDC bits. Torque generated by each cutter is related to its radial position, with greater torque being generated as the radial distance increases. When directionally drilling or when not directly on center, there are loads attributed at one particular angle around. With conventional PDC drill bits, when a single blade arrives at that concentrated angle, torque is maximized, especially at the outer periphery. When the concentrated angle is between blades, the torque is minimized. The difference between the torque values at the blades and the torque values between the blades is torque fluctuation or "dysfunction." The large torque fluctuations of conventional bits leads to bit whirling, while the relatively homogeneous distribution of cutters in PDC drill bits of the present invention minimizes such fluctuations.

Figure 2:
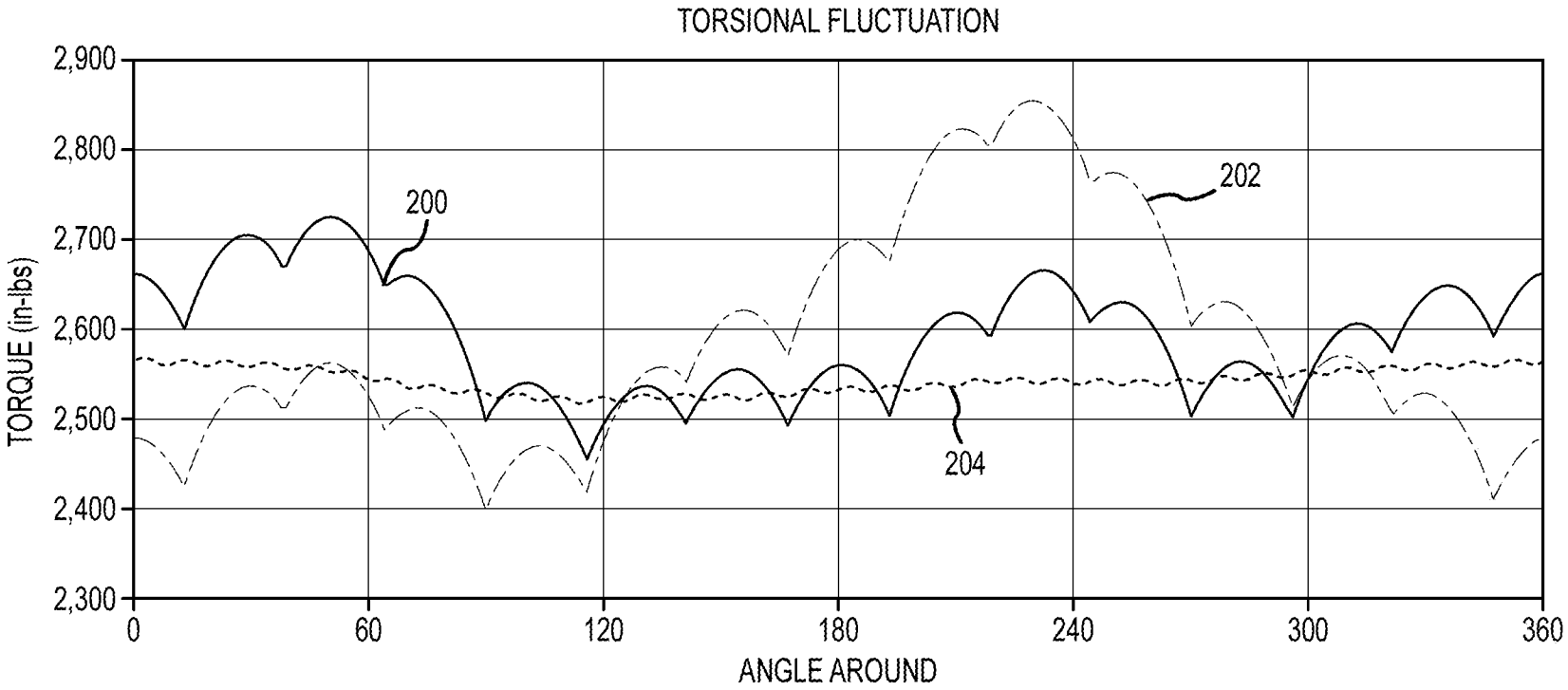
FIG. 2 is a chart illustrating torque profiles for a conventional bladed PDC drill bit and a bladeless PDC drill bit according to embodiments of the invention.

For example, as illustrated in FIG. 2, torque profiles 200 and 202 for conventional PDC bits demonstrates that the conventional drill bit experiences significant fluctuations, with torque values between about 2080-2490 ft.-lbs. In contrast, a torque profile 204 for a bladeless PDC bit in accordance with the present invention (similar to that illustrated in FIGS. 1A and 1B) demonstrates that the bladeless PDC drill bit experiences substantially constant torque values ranging between about 2235-2275 ft.-lbs. This consistent torque profile results from a reduction in torsional fluctuation and helps reduce loads on individual cutters 118. This in turn reduces wear of the bit and also reduces and the presence of high concentrations of torque generation on the PDC drill bit 100. The lower, more consistent torque response also reduces the occurrence of bit whirl that is typically associated with high torque values and high fluctuations in torque values. This torque response is a result of the inventive drill bit not having concentrations of cutters 118 at similar angles around the PDC drill bit 100, especially proximate the outer periphery of the PDC drill bit 100.

In an ideal world, the drill bit is drilling on center with all cutters engaging the formation equally. However the majority of the time, there are lateral forces involved that either intentionally force the bit to favor one side through directional drilling, or unintentionally cause the bit to rotate about an axis different than the bit's axis through whirl. This off-center rotation causes some cutters to preferentially engage the formation on one side. By engaging more formation, these cutters will generate more torque than cutters on the opposite side of the bit that are engaging the formation less. This imbalance of torque results in fluctuation. In order to model this fluctuation, the lateral force is defined by a magnitude and direction. The magnitude represents how much more formation the cutters will engage laterally versus axially. As the bit rotates and a cutter angle around reaches the same angle around as the lateral force, the torque reaches its maximum value. As the cutter moves away from this angle, the torque value for that cutter is reduced, until it reaches its minimum value opposite the angle around of the lateral force. In order to simulate the entire bit's torsional fluctuation, the sum for all cutters' torque on the bit is taken at every instance in a revolution. When all cutters on a single blade reach the angle of the lateral force, their torque is maximized, and a higher total torque is reached for the entire bit. As the lateral force angle aligns between blades, the total torque values reach their minimum. The difference between the maximum and minimum values produces a fluctuation. The more cutters are grouped by angles around, the greater the fluctuations that are created. The fluctuations exhibited by the standard PDC drill bits in profiles 200 and 202 demonstrate this phenomenon. Embodiments of the present invention reduce these fluctuations as shown in profile 204 by providing cutters at a much more favorable angle around distribution.

Turning back to FIG. 1B, the head 102 of the PDC drill bit 100 may be divided into different zones having equal areas. For example, an innermost zone may be circular and coaxial with the central axis 110 of the PDC drill bit 100, while subsequent zones are in the form of annular areas that are concentric with the innermost zone. An outer boundary of each of the cutting zones may be determined based on a relationship of $$R_Z = \sqrt{\frac{Z * D_H^2}{4 * N}},$$

where Z is a zone number representing a particular cutting zone on the head 102, $D_H$ is a diameter of the drilling face of the head 102; N is a number of cutting zones on the head 102, and $R_Z$ is a radial position of the outer boundary of the particular cutting zone. When divided into zones in this manner, the cutters 118 placed in each zone may collectively cut approximately equal volumes of drilling material. For example, in a 4-zone arrangement, the cutters 118 in the innermost zone may cut approximately 25% of the total volume of drilling material that the PDC drill bit 100 cuts at any given time. Similarly, the cutters in each of the 3 annular zones of equal area will also cut approximately 25% of the total volume of drilling material that the PDC drill bit 100 cuts at any given time such that collectively the cutters in all 4 zones account for 100% of the volume of drilling material that the PDC drill bit 100 cuts at any given time.

Oftentimes, the head 102 will be divided into 3 or 4 zones, although in some embodiments other numbers of zones may be utilized. Table 1 below shows the outer boundary positions of each zone for heads 102 with 3 and 4 zones, respectively.

| Zone Number | Outward Boundary (3 zones) | Outward Boundary (4 zones) |
|---|---|---|
| 1 | 0.2887*D | 0.2500*D |
| 2 | 0.4082*D | 0.3536*D |
| 3 | 0.500*D | 0.4330*D |
| 4 | N/A | 0.5000*D |

In some embodiments, the use of 3 or 4 zones may be used to approximate the boundaries of the cone section 108, the nose section 112, and/or the shoulder section 114. For example, in a 3-zone PDC drill bit 100, the first zone may approximate the cone section 108, the second zone may approximate the nose section 112, and the third zone may approximate the shoulder section 114. In a 4-zone PDC drill bit 100, the first zone may approximate the cone section 108, the second zone may approximate the nose section 112, and the third zone and fourth zones together may approximate the shoulder section 114.

Particular distributions of cutters 118 in each zone may also help eliminate or reduce high torque concentration areas on the PDC drill bit 100 and helps increase the lifespan of the PDC drill bit 100, as well as help eliminate or reduce bit whirl. This is due to the force, work, and heat generation experienced at different radial locations on the PDC drill bit 100. Notably, at more central portions of the PDC drill bit 100 (such as the cone section 108 and/or nose section 112) the forces exhibited on individual cutters 118 is highest, while the work and heat generation are lower. This is due to the fact that both work and heat generations are functions of radial position. Greater work is being performed in the shoulder because the distance the outer cutters travel is greater than the inner cutters. Greater heat is being generated because the linear speed of the outer cutters is faster, by having to cover a greater distance in the same amount of time the inner cutters travel. To address these issues, some embodiments utilize a greater number of cutters 118 positioned in more outward zones, which may help more evenly distribute the greater torque, work, and heat generation experienced by the PDC drill bit 100 near its outer periphery onto a greater number of cutters 118, thereby minimizing the detrimental effects associated with work and heat as applied to any individual cutter 118 and/or angular region of the PDC drill bit 100. A smaller number of cutters 118 may be positioned near the cone section 108 as the small radial distances associated with such cutters 118 leads to lower work and force values, even though these cutters 118 may exhibit the highest force magnitudes. Once a total number of cutters 118 is selected, the cutters 118 may be arranged in the various zones. Typically, the difference in radial position between a particular cutter 118 and a subsequent cutter 118 (from the central axis 110 outward) gets smaller as the cutters 118 move further away from the central axis 110, which provides a substantially uniform distribution of cutters 118 along the face of the head 102.

In some embodiments, the cutters 118 may be arranged about the face of the PDC drill bit 100 such that the cutters 118 are generally evenly distributed within zones separated by radial boundaries. For example, the face of the PDC drill bit 100 may be divided into wedge-shaped zones of approximately equal areas that extend from the central axis 110 to an outer periphery of the PDC drill bit 100. Approximately equal (within 1-3) numbers of cutters 118 may be positioned within each of the zones. In such embodiments, the face of the PDC drill bit 100 may be divided into any number of zones at any position about the face and the number of cutters 118 in each zone will be approximately equal. Such arrangements help balance the PDC drill bit 100 and ensure that a consistent torque response is generated as indicated in greater detail in the discussion related to FIG. 2.

It will be appreciated that other arrangement of the cutters 118 may be possible, and that the techniques described above may be applied to drive the layouts of any number of cutters on any number of zones of a particular PDC drill bit 100.

In some embodiments, along with having a unique angular position, each of the cutters 118 may have a unique radial position (radial distance from the central axis 110) as demonstrated in FIG. 1B. In some embodiments, the radial position (distance from the central axis 110 of the head 102) may be driven formulaically as well. For example, radial positions of the cutters 118 may be generally based on a square root of a cutter number (integer) that is assigned to each cutter 118, with the innermost cutter 118 being assigned the lowest cutter number. As the integers increase, the radial position of the cutters is incremented by smaller and smaller amounts. This results in an arrangement of cutters 118 having increasing radial positions, with the radial distributions being more compart toward an outer periphery of the PDC drill bit 100. In a specific embodiment, an equation for the radial position of each of the cutters 118 may be $$R_i = a\sqrt{\frac{1}{i^{\frac{1}{k}}}},$$

where R is the radial location, a is a scalar value, i is a distinct cutter number, n is the number of cutters, and k is a spacing constant. In some embodiments, the spacing constant k may be ½ or 1 (although other spacing constants may be used). In such embodiments, the angular position of each cutter 118 may be based on increments of approximately the golden angle, as described above. For example, as the radial position of cutters 118 increases, each subsequent cutter 118 is at or near the golden angle away from the previous cutter.

In some embodiments, the cutters 118 may be placed parametrically by length of profile based on an exponent between ½ and 1. An exponent of 1 results in even radial spacing between each discrete cutter 118, while an exponent of ½ may result in variable radial spacing between adjacent ones of the cutters 118.

The radial locations of cutters 118 and their relative spacing has a large effect on how the loads are shared across the whole PDC drill bit 100. Thus, in some embodiments, the radial locations of cutters 118 can be determined simply by dividing the length of the bit profile by the number of cutters 118. The profile shape plays a large role in ensuring a favorable distribution of loads.

A more complex way of determining radial locations is to vary the spacing at select areas of the bit. This can be done by assigning arbitrary spacing factors to critical cutters such as the first (innermost) cutter 118, last (outermost) cutter 118, and a specific cutter 118 in the middle. Next, relationships are defined to assign a value to all cutters 118 in between these selected cutters 118 so that every cutter 118 receives its own factor based on its cutter number with smooth transitions in between the critical cutters 118. The radial position of the first and last cutter 118 must be predetermined based on preferential distance to the central axis 110 and a diameter of the PDC drill bit 100. Each cutter's length from the center line 110 along the profile is defined by the equation:

$$L_i = L_1 + (L_{last} - L_1) * \frac{\sum_1^i F}{\sum_1^{last} F}$$

Where i represents the cutter number, and F represents the spacing factor. The length must then be converted to a radial position through the profile definition.

Layouts according to similar formulae create a smooth torque response and stable environment given any lateral dysfunction because 1) there is no angular concentration of cutters 118 at any location on the PDC drill bit 100, thereby limiting the force and torque at any instance of time, 2) in applications of heterogeneous rock or other drilling material formations, embodiments of the present invention provide a singularity of cutters 118 in contact with the differing formation versus having groups of cutters 118 in similar radial locations and angles around (such as in conventional bladed bits), and 3) if the PDC drill bit 100 must pivot off of a highly engaged cutter 118 or group of cutters 118, there will always be another cutter 118 to engage the formation in the vicinity of any necessary angle around, thereby limiting the response of the destabilizing force.

In some embodiments, the radial positions of the cutters may not be unique. For example, in some embodiments, the cutters 118 may be arranged as a plural set, with the cutters 118 being laid out in opposing pairs such that each cutter 118 has a corresponding cutter 118 at the same radial position, but at an angular position that is rotated approximately 180° relative to the central axis 110. In such embodiments, each pair may be laid out as described above, with successive pairs of cutters incremented by approximately the golden angle and with subsequent pairs being spaced further toward the outer periphery of the head 102.

In some embodiments, some of the cutters 118 may be primary cutters 118 while others are backup cutters 118. The primary cutters 118 may be arranged in accordance with the techniques described above, while each backup cutter 118 may be positioned at a same radial position as a corresponding one of the primary cutters 118 while having an angular position that is slightly offset from that of the primary cutter 118 such that the backup cutter 118 is positioned almost directly behind the primary cutter 118 and may be positioned on a same knot 122 as a corresponding primary cutter 118. The backup cutter 118 is oriented in nearly the same direction as the primary cutter 118. Oftentimes, the backup cutters 118 will be offset inward from the primary cutters 118 such that the backup cutters 118 do not engage the drilling material until a corresponding one of the primary cutters 118 is damaged.

As illustrated, a number of fluid ports 128 are formed through the head 102 such that each fluid port 128 extends through the drilling surface of the head 102. In some embodiments, the fluid ports may be fixed ports having a set diameter, while in other embodiments, the fluid ports 128 may have adjustable nozzles that allow the diameter of the ports 128 to be changed to adjust velocities of fluid flowing therethrough. For example, the fluid ports 128 may be carbide nozzles that allow for variable port diameters. These fluid ports 128 are designed to be connected to fluid lines upstream of the PDC drill bit 100 and are configured to deliver cooling fluid to the drilling surface of the head 102. As illustrated here, the fluid ports 128 are positioned between, through, and/or against bases of individual ones of the knots 122, typically within the cone section 108 and/or nose section 112, although the fluid ports 128 may be placed at more outward positions in some embodiments. The fluid ports 128 of the present invention are placed on the drilling surface in such a manner that at least one cutter 118 and/or knot 122 is disposed in a path between each fluid port 128 and the junk slots 124 defined along the outer periphery of the PDC drill bit 100. In some embodiments, the knots 122 are arranged such that knots 122 closer to the outer periphery of the PDC drill bit 100 are spaced apart from one another at a greater distance than those knots 122 that are more centrally positioned. This increased distance creates additional room or standoff that allows a path for cuttings and fluid to pass through to the junk slots 124. This arrangement improves cutter cooling because the design forces fluid to engage the individual cutters wholly laterally, rather than just flowing down junk slots quickly as done in conventional bladed PDC drill bits.

Figure 3A:
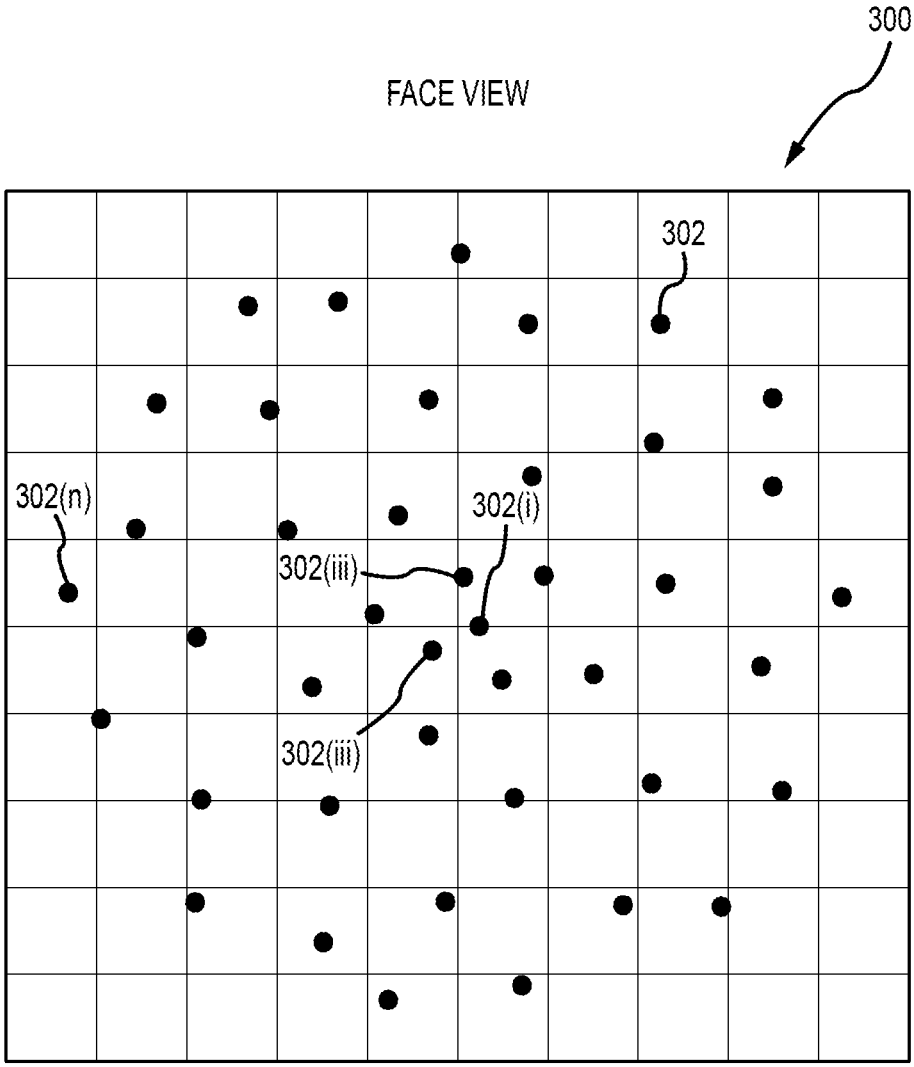
FIG. 3A illustrates a face view of radial and angular positions of discrete cutters on a PDC drill bit according to embodiments of the invention.
Figure 3B:
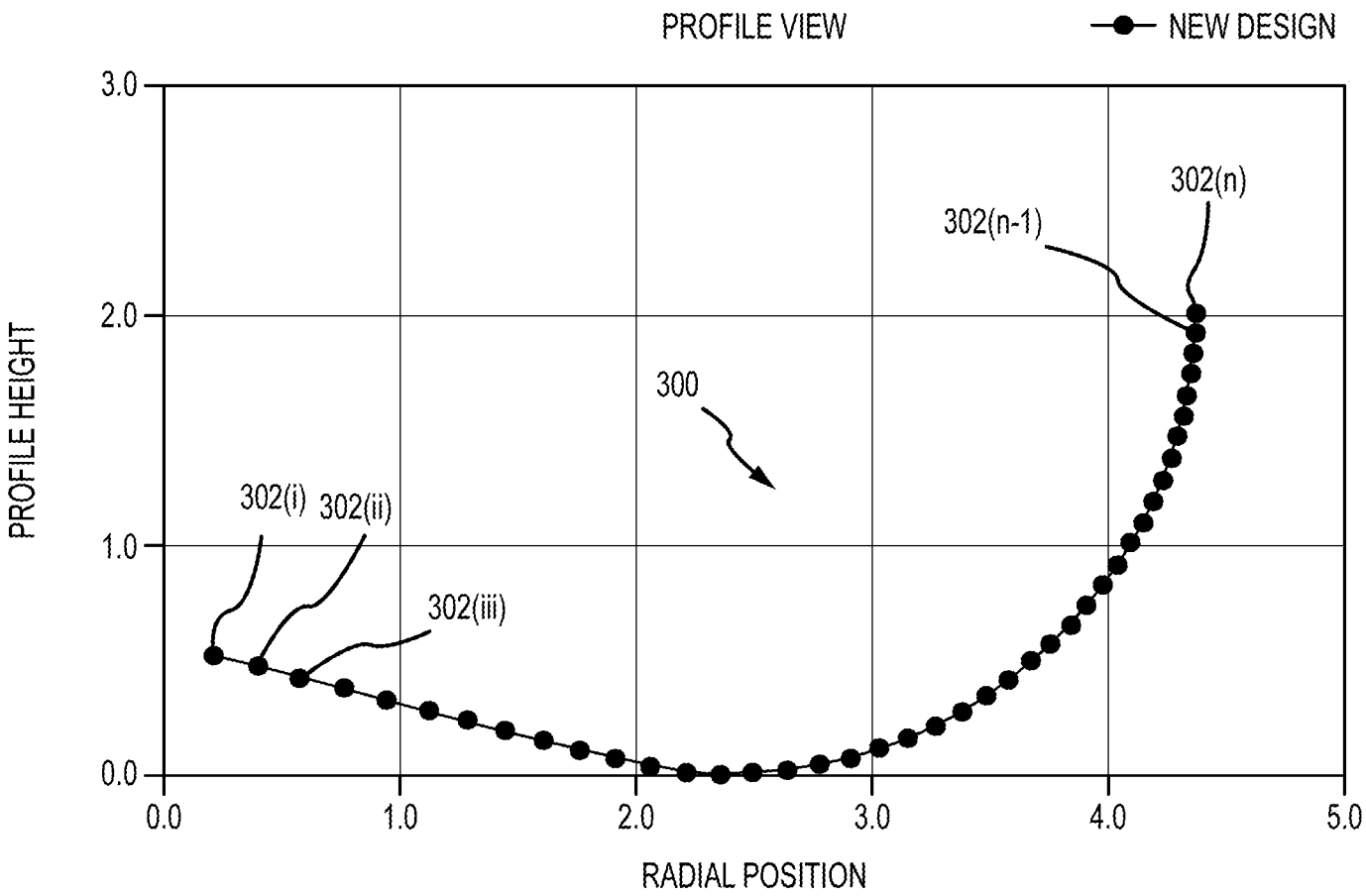
FIG. 3B illustrates a profile view of radial positions of discrete cutters on the PDC drill bit of FIG. 3A.

FIGS. 3A and 3B show graphical representations of the radial and/or angular arrangement of discrete cutter positions 302 of a PDC drill bit 300 in accordance with embodiments of the present invention. PDC drill bit 300 may be similar to PDC drill bit 100, and may have the positions 302 of individual cutters arranged in a similar manner as cutters 118. FIG. 3A is a face view of the PDC drill bit 300 and illustrates the positions 302, both angular and radial, of each cutter of the PDC drill bit 300. Typically, the positions 302 of the cutters refer to a position of the leading edge of an individual cutter, but other points of reference for a particular cutter may be used to arrange the cutters on the drilling face of the PDC drill bit 300. As illustrated, a position 302(*i*) of the first (most radially inward) cutter is positioned such that an angular position of the start of the angular increments starts at 0°, where 0° extends toward a right of the PDC drill bit 300 (although it will be appreciated that any other angular position may be used and/or chosen for the 0° location). As shown here, the position 302(*ii*) of the second cutter is rotated clockwise by approximately the golden angle and is at the 137.5 degree position. The position 302(*iii*) of the third cutter may be rotated approximately by 137.5 degrees relative to position 302(*ii*) and is at the 275 degree position. Each subsequent cutter position 302 moving outward until position 302(*n*) is rotated by approximately 137.5 degrees relative to the preceding position 302 until all the cutters are arranged on a face of the PDC drill bit 300. As illustrated, such angular incrementing of the positions 302 of each of the cutters ensures that no two cutters share the same angular position 302. Based on the position 302 of each cutter, the position of knots (not shown) on which each cutter is mounted may be determined.

As noted above, in some embodiments backup cutters may be positioned proximate (trailing) some or all of the cutters whose positions 302 are depicted in FIG. 3A. In such embodiments, the incrementing may be based on the primary cutter positions 302 and the arrangement may ensure that no two primary cutters have the same angular position 302. In some embodiments, pairs of cutters may be positioned at the same radial positions but with angular positions that are 180 degrees apart, with subsequent pairs of cutters being incremented by approximately 137.5 degrees. Additionally, while shown with the positions being incremented angularly in a clockwise direction, in some embodiments the increments may be performed in a counterclockwise direction.

As shown here, the positions 302 of each of the cutters are unique in a radial sense as well. In the present embodiment, differences between the radial positions 302 of the various cutters are reduced as the cutters move outward, resulting in a radial arrangement of cutter positions 302 that gradually expands toward the outer boundary of the PDC drill bit 300. Such an arrangement of radial positions 302 is shown in greater detail in FIG. 3B, which depicts a profile view of the cutter positions 302 of PDC drill bit 300. In the illustrated embodiment, the spacing between the positions 302(*i*) and 302(*ii*) is greatest, and gradually tapers until the smallest spacing between positions 302(*n*−1) and 302(*n*). This results in greater numbers of cutters being concentrated at ranges of radial positions that are furthest from a central axis of the PDC drill bit 300, which allows for a relatively even distribution of cutters along the face of the PDC drill bit 300 based on the expanding circumference generated as the radial positions are increased. In some embodiments, the radial positions 302 of each cutter are determined as described in relation to FIGS. 1A and 1B. As just one example, the radial positions 302 may be determined based on the equation $$R_i = a\sqrt{i^{\frac{1}{k}}},$$

although other techniques for determining the radial positions 302 may be used in accordance with the present invention.

As discussed above, in embodiments with backup cutters and/or opposing pairs of cutters, specific sets of the cutters may have the same radial position 302. Additionally, it will be appreciated that similar arrangements of cutter positions 302 (angular and/or radial) may be done with any number of cutters, as the illustrated embodiment is provided as merely one example. Other techniques for arranging the cutters along the drilling face of the PDC drill bit 300 may be utilized. For example, while many embodiments of the invention may involve angular and radial positions 302 arranged in a same or similar manner as the curves shown in FIGS. 3A and 3B, it will be appreciated that embodiments are not so limited and that other distribution curves and/or profiles may be utilized that provide well-distributed cutters without large concentrations of cutters at any one region of the PDC drill bit 300.

Figure 4:
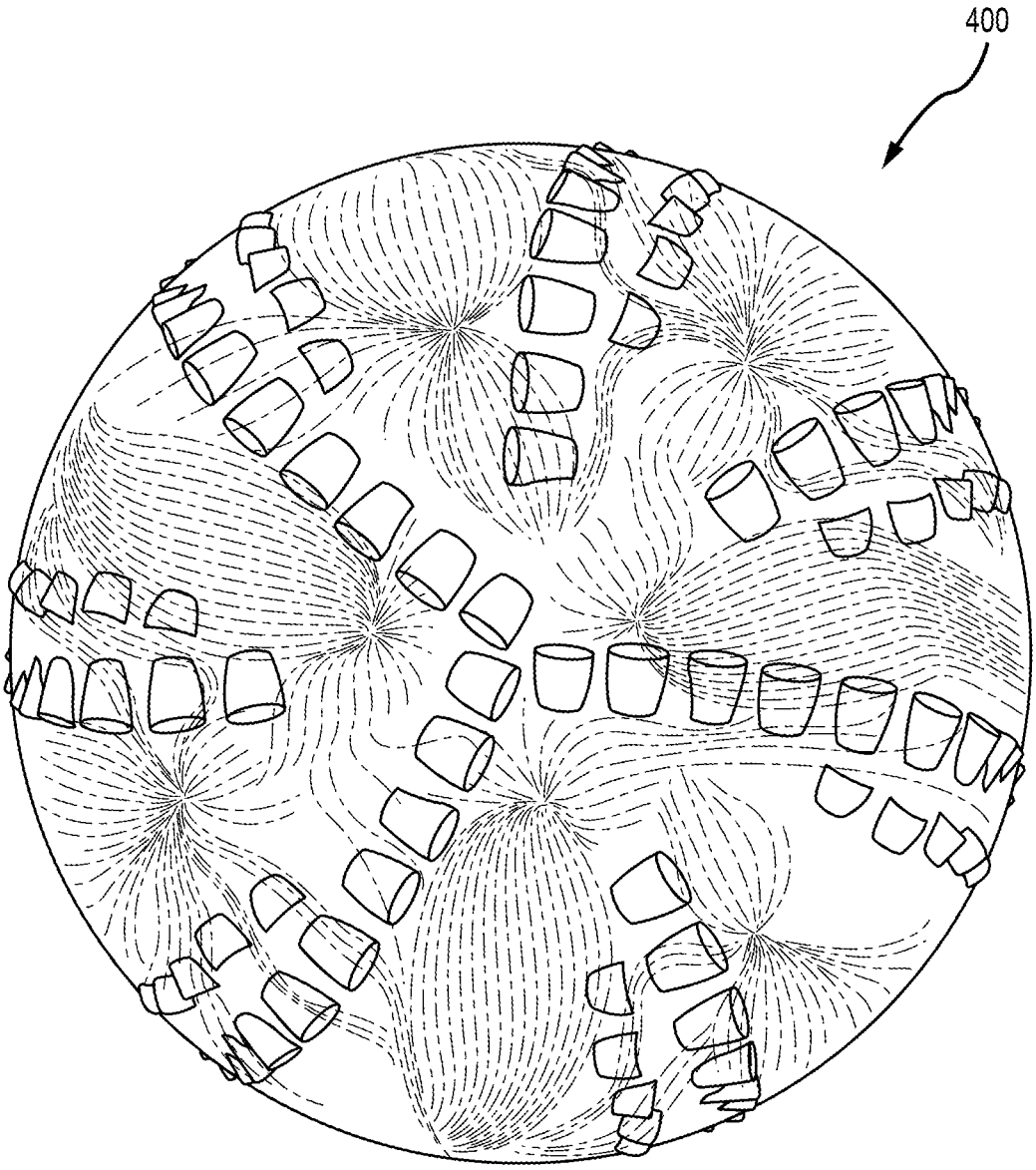
FIG. 4 depicts a cooling fluid flow path for a conventional bladed PDC drill bit.
Figure 5:
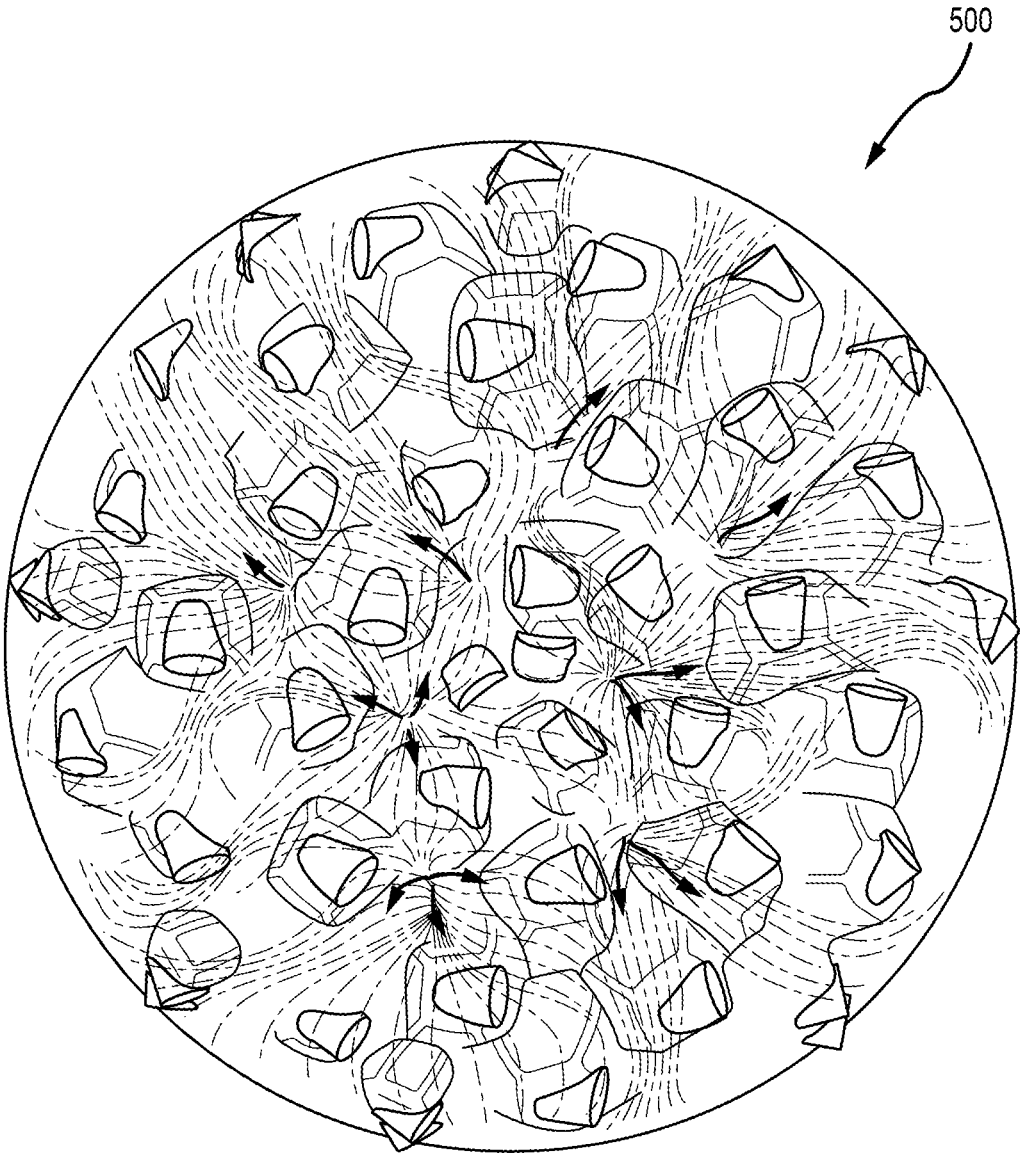
FIG. 5 depicts a cooling fluid flow path for a bladeless PDC drill bit according to embodiments of the invention.

As noted above, the arrangement of the cutters on the PDC drill bit in accordance with the present invention (such as described in relation to PDC drill bit 100 and/or PDC drill bit 300) may provide benefits in how the individual cutters of the PDC drill bit are cooled in relation to conventional bladed PDC bits. FIGS. 4 and 5 illustrate the cooling fluid flow paths associated with a conventional bladed PDC bit 400 and a PDC drill bit 500, respectively. PDC drill bit 500 may be designed in using the techniques disclosed herein in accordance with the present invention and may be similar to PDC drill bit 100 and/or PDC drill bit 300. As shown, with the conventional bit 400, the cooling fluid primarily flows directly down the junk slots formed between the discrete blades such that the primary cooling fluid flow only contacts a cutting edge of each of the cutting elements. In such bit designs, only incidental spillover or splashing of the fluid allows any contact between the cooling fluid and either a top surface of the blade or a main body of any of the cutting elements. This incidental contact is not predictable or consistent and cannot be relied upon to repeatedly and effectively cool the body of the cutting elements. Such bladed designs therefore provide a limited cooling profile, as the ability of fluid to cool is related to area of contact of a particular cutter with that fluid. In contrast, the placement of the fluid ports in accordance with the present invention forces the cooling fluid to contact all or a substantial number of the cutters of the PDC bit 500 wholly laterally in a manner that drives the flow of the cooling fluid over a significant portion of the body of many of the cutters. This is due to the fluid paths from the fluid ports to the junk slots being interrupted by a matrix of cutters and knots that forces the cooling fluid to flow over a significant portion of the drilling face of the bit, which includes a significant portion of the cutter bodies of some or all of the cutters. The exposure to cooling fluid by a greater surface area of each cutter improves the cooling ability of PDC drill bits in accordance with the present invention.

In some embodiments, all the cutters on a particular PDC drill bit may have the same size. In other embodiments, multiple cutter sizes may be used in a single PDC drill bit to achieve specific objectives. For example, such a design could include two separate cutter layouts that use similar algorithms to determine angular and/or radial positions, with a boundary being formed between the two layouts with a break in the angle around used. As just one example, larger cutters may be positioned in an interior of the face of the PDC drill bit, while smaller cutters are positioned proximate an outer periphery of the PDC drill bit. Such an arrangement may be used to reduce the torque generated by particular cutters, as the more outward cutters generate higher torque values based on their greater radial distance from the central axis of the PDC drill bit. It will be appreciated that this is merely one example of a bit having cutters of different sizes and that other arrangements are possible, such as arrangements with smaller cutters positioned near the outer periphery of the drill bit.

It will be appreciated that in some embodiments, only a substantial portion (greater than 80%, 90%, 95%, etc.) of the cutters 118 may have unique angular positions, while a select number of the cutters 118 may share a same, or approximately the same (within 1-3 degrees) angular position. As just one example, gauge cutters 118 may share knot 122 and/or gauge pad 126 with the outer-most shoulder cutters 118. These cutters 118 may have the same or similar angular position. It will be appreciated that other arrangements where two or more cutters 118 share a same or similar angular arrangement may be contemplated without departing from the scope of the invention as long as a substantial portion of the cutters 118 do maintain unique angular positions.

Figure 6:
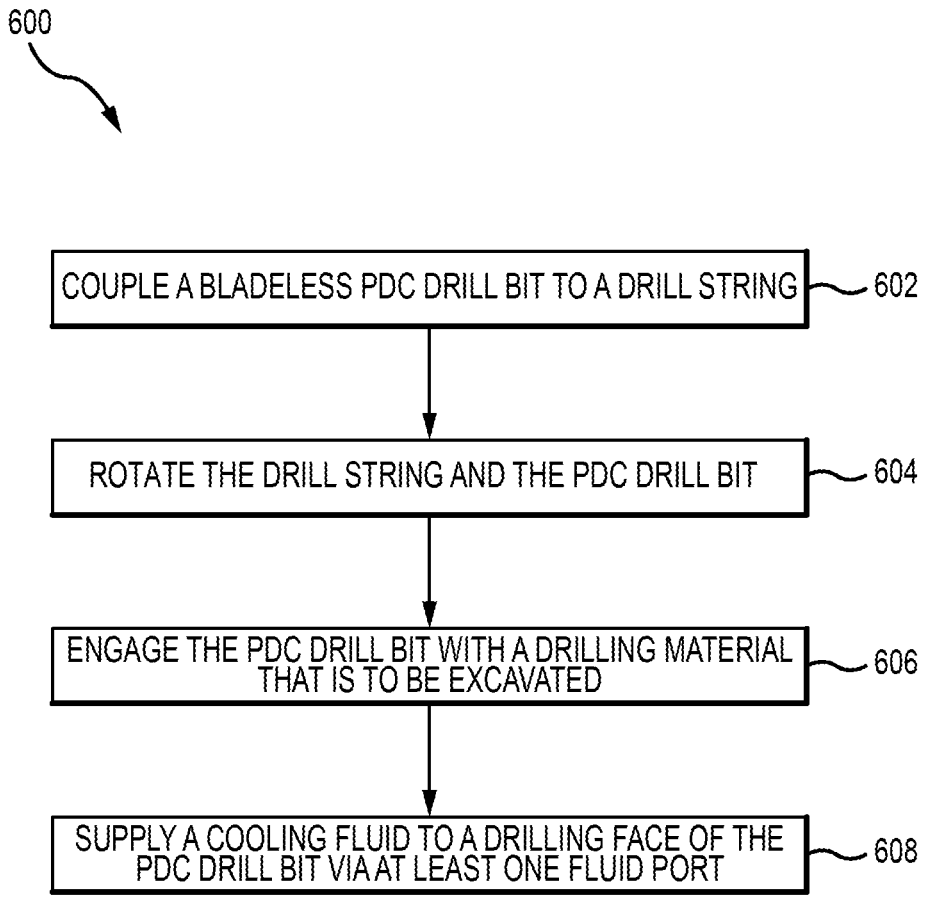
FIG. 6 is a flowchart illustrating a process for operating a PDC drill bit according to embodiments of the invention.

FIG. 6 is a flowchart illustrating a process 600 of operating a PDC drill bit according to embodiments of the invention. Process 600 may be performed using a PDC drill bit designed in accordance with the techniques disclosed herein, and may be similar to PDC drill bit 100, PDC drill bit 300, and/or PDC drill bit 500 described above. Process 600 may begin at block 602 by coupling a bladeless PDC drill bit to a drill string. In some embodiments, this may be done by engaging a wrench portion of a bit breaker box with a breaker slot formed in the shank of a drill bit. The angular position of the bit breaker box may be fixed while the drill string is rotated to thread the PDC drill bit onto the drill string. Once the PDC drill bit is coupled to the drill string, the drill string and the PDC drill bit may be rotated at block 604. The PDC drill bit may then be engaged with a drilling material to be excavated at block 606. In some embodiments, the process 600 may also include supplying a cooling fluid to the drilling face of the PDC drill bit via the at least one fluid port at block 608 such that the cooling fluid engages multiple of the cutters wholly laterally. This may be done via fluid ports that are provided between individual ones of the cutters and knots such that a flow path from each of the fluid ports to junk slots of the PDC drill bit are interrupted by a matric of cutters and knots.

The methods, systems, and devices discussed above are examples. Some embodiments were described as processes depicted as flow diagrams or block diagrams. Although each may describe the operations as a sequential process, many of the operations can be performed in parallel or concurrently. In addition, the order of the operations may be rearranged. A process may have additional steps not included in the figure.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

Also, the words "comprise", "comprising", "contains", "containing", "include", "including", and "includes", when used in this specification and in the following claims, are intended to specify the presence of stated features, integers, components, or steps, but they do not preclude the presence or addition of one or more other features, integers, components, steps, acts, or groups.

Unless defined otherwise, all technical and scientific terms used herein have the same meaning as commonly or conventionally understood. As used herein, the articles "a" and "an" refer to one or to more than one (i.e., to at least one) of the grammatical object of the article. By way of example, "an element" means one element or more than one element. "About" and/or "approximately" as used herein when referring to a measurable value such as an amount, a temporal duration, and the like, encompasses variations of ±20% or ±10%, ±5%, or +0.1% from the specified value, as such variations are appropriate to in the context of the systems, devices, circuits, methods, and other implementations described herein. "Substantially" as used herein when referring to a measurable value such as an amount, a temporal duration, a physical attribute (such as frequency), and the like, also encompasses variations of ±20% or ±10%, ±5%, or +0.1% from the specified value, as such variations are appropriate to in the context of the systems, devices, circuits, methods, and other implementations described herein.

As used herein, including in the claims, "and" as used in a list of items prefaced by "at least one of" or "one or more of" indicates that any combination of the listed items may be used. For example, a list of "at least one of A, B, and C" includes any of the combinations A or B or C or AB or AC or BC and/or ABC (i.e., A and B and C). Furthermore, to the extent more than one occurrence or use of the items A, B, or C is possible, multiple uses of A, B, and/or C may form part of the contemplated combinations. For example, a list of "at least one of A, B, and C" may also include AA, AAB, AAA, BB, etc.

What is claimed is:

1. A bladeless polycrystalline diamond compact (PDC) drill bit, comprising:

a head having a plurality of knots protruding from a drilling face of the head, each of the plurality of knots comprising a single cutter, wherein:

each of the cutters is arranged about a central axis of the head such that each cutter has a unique radial distance from the central axis and a substantial number of the cutters have unique angular positions relative to the central axis;

the angular position of each successive one of the cutters is incremented by between about 131 and 143 degrees starting from an innermost cutter relative to the central axis;

each successive one of the cutters being a cutter with a next smallest radial distance from the central axis as compared to a previous cutter; and the head defines at least one fluid port extending through the drilling surface.

2. The bladeless polycrystalline diamond compact (PDC) drill bit of claim 1, wherein:

the at least one fluid port extends through the drilling surface between bases of respective ones of the plurality of knots.

3. The bladeless polycrystalline diamond compact (PDC) drill bit of claim 1, wherein:

each of the at least one fluid port provides a fluid path through the head such that fluid supplied through each of the at least one fluid port engages multiple of the cutters wholly laterally.

4. The bladeless polycrystalline diamond compact (PDC) drill bit of claim 1, wherein:

a difference in the radial distance of successive cutters near the central axis is greater than the difference in the radial distance of successive cutters further from the central axis.

5. The bladeless polycrystalline diamond compact (PDC) drill bit of claim 1, wherein:

spacing between adjacent cutters is equal in all angular directions.

6. The bladeless polycrystalline diamond compact (PDC) drill bit of claim 1, wherein:

the plurality of knots cover substantially an entirety of the drilling surface of the head.

7. A bladeless polycrystalline diamond compact (PDC) drill bit, comprising:

a head having a plurality of cutters, wherein each of the plurality of cutters is positioned on a knot that protrudes outward from a drilling face of the head, wherein:

each of the cutters is arranged about a central axis of the head such that each cutter has a unique radial distance and a unique angular position relative to the central axis;

the angular position of each successive one of the plurality of cutters following an innermost one of the plurality of cutters is incremented approximately by a golden angle;

each successive one of the cutters is a cutter with a next smallest radial distance from the central axis as compared to a previous cutter; and the head defines at least one fluid port extending through the drilling surface.

8. The bladeless polycrystalline diamond compact (PDC) drill bit of claim 7, wherein:

a leading edge of each of the plurality of cutters is oriented such that the leading edge is normal to the central axis of the head.

9. The bladeless polycrystalline diamond compact (PDC) drill bit of claim 7, wherein:

each of the plurality of cutters is brazed to a respective knot.

10. The bladeless polycrystalline diamond compact (PDC) drill bit of claim 7, wherein:

at least some of the knots comprise multiple ones of the plurality of cutters.

11. The bladeless polycrystalline diamond compact (PDC) drill bit of claim 7, wherein:

each knot is integrally formed with the head of the PDC drill bit.

12. The bladeless polycrystalline diamond compact (PDC) drill bit of claim 7, wherein:

each of the plurality of cutters comprises a generally flat leading edge.

13. The bladeless polycrystalline diamond compact (PDC) drill bit of claim 12, wherein:

each of the generally flat leading edges is oriented in a different angular direction.

14. A bladeless polycrystalline diamond compact (PDC) drill bit, comprising:

a head having a plurality of cutters, wherein each of the plurality of cutters is positioned on a knot that protrudes outward from a drilling face of the head, wherein:

an angular position of each successive one of the plurality of cutters following an innermost one of the plurality of cutters is incremented by between about 131 and 143 degrees about a central axis of the head such that the angular position of each of the cutters is unique;

each successive one of the cutters is a cutter with a next smallest radial distance from the central axis as compared to a previous cutter; and the head defines a plurality of fluid ports extending through the drilling surface at positions between the plurality of cutters.

15. The bladeless polycrystalline diamond compact (PDC) drill bit of claim 14, wherein:

at least some of the knots include both a primary cutter and a backup cutter that is positioned generally behind the primary cutter.

16. The bladeless polycrystalline diamond compact (PDC) drill bit of claim 14, wherein:

each of the plurality of cutters comprises a unique radial distance relative to the central axis; and the radial distance of each of the plurality of cutters is determined based on a particular one of a plurality of cutter zones within which a particular one of the plurality of cutters is placed.

17. The bladeless polycrystalline diamond compact (PDC) drill bit of claim 16, wherein:

each of the plurality of cutting zones has a same 2-dimensional area relative to the drilling face of the head; and an outer boundary of each of the plurality of cutting zones is determined based on a relationship of $$R_Z = \sqrt{\frac{Z * D_H^2}{N}},$$

where Z is a zone number representing a particular cutting zone on the head, $D_H$ is a diameter of the drilling face of the head; N is a number of cutting zones on the head, and $R_Z$ is a radial distance of the outer boundary of the particular cutting zone relative to the central axis.

18. The bladeless polycrystalline diamond compact (PDC) drill bit of claim 14, wherein:

the plurality of cutters are arranged as opposing pairs that are spaced 180 degrees apart relative to the central axis of the head; and each cutter within a set of opposing pairs is spaced at a same radial distance relative to the central axis.

19. The bladeless polycrystalline diamond compact (PDC) drill bit of claim 14, wherein:

at least some of the plurality of cutters are of different sizes.

20. A method of using a bladeless polycrystalline diamond compact (PDC) drill bit, comprising:

coupling a bladeless PDC drill bit to a drill string, the bladeless PDC drill bit comprising:

a head having a plurality of knots protruding from a drilling face of the head, each of the plurality of knots comprising a single cutter, wherein:

each of the cutters is arranged about a central axis of the head such that each cutter has a unique radial distance relative to the central axis and angular position relative to the central axis;

the angular position of each successive one of the cutters is incremented by between about 131 and 143 degrees starting from an innermost cutter relative to the central axis;

each successive one of the cutters is a cutter with a next smallest radial distance from the central axis as compared to a previous cutter; and the head defines at least one fluid port extending through the drilling surface;

rotating the drill string and the bladeless PDC drill bit; and engaging the bladeless PDC drill bit with a material to be excavated.

21. The method of using a bladeless polycrystalline diamond compact (PDC) drill bit of claim 20, further comprising:

supplying a cooling fluid to the drilling face of the bladeless PDC drill bit via the at least one fluid port such that the cooling fluid engages multiple of the cutters wholly laterally.

22. The method of using a bladeless polycrystalline diamond compact (PDC) drill bit of claim 20, wherein:

the angular position of each successive one of the cutters is incremented in a clockwise direction.

* * * * *